US006333720B1

(12) United States Patent
Göttl et al.

(10) Patent No.: US 6,333,720 B1
(45) Date of Patent: Dec. 25, 2001

(54) DUAL POLARIZED MULTI-RANGE ANTENNA

(75) Inventors: Maximilian Göttl, Grosskarolinenfeld; Roland Gabriel, Griesstätt; Georg Klinger, Saaldorf-Surheim, all of (DE)

(73) Assignee: Kathrein-Werke AG, Rosenheim (DE)

( * ) Notice: Subject to any disclaimer, the term of this patent is extended or adjusted under 35 U.S.C. 154(b) by 0 days.

(21) Appl. No.: 09/673,727

(22) PCT Filed: May 20, 1999

(86) PCT No.: PCT/EP99/03484

§ 371 Date: Oct. 20, 2000

§ 102(e) Date: Oct. 20, 2000

(87) PCT Pub. No.: WO99/62139

PCT Pub. Date: Dec. 2, 1999

(30) Foreign Application Priority Data

May 27, 1998 (DE) ..... 198 23 749

(51) Int. Cl.[7] ..... H01Q 21/00

(52) U.S. Cl. ..... 343/810; 343/797

(58) Field of Search ..... 343/795, 797, 343/798, 803, 805, 853, 810, 840

(56) References Cited

U.S. PATENT DOCUMENTS

| | | | | |
|---|---|---|---|---|
| 3,475,758 | * | 10/1969 | Vito | 343/797 |
| 4,434,425 | | 2/1984 | Barbano | 343/797 |
| 5,173,715 | * | 12/1992 | Rodal et al. | 343/795 |
| 5,481,272 | | 1/1996 | Yarsunas | 343/797 |
| 5,629,713 | * | 5/1997 | Mailandt et al. | 343/808 |
| 6,023,244 | * | 2/2000 | Snygg et al. | 343/700 MS |
| 6,025,812 | * | 2/2000 | Gabriel et al. | 343/797 |

FOREIGN PATENT DOCUMENTS

| | | |
|---|---|---|
| 10 11 010 | 6/1957 | (DE) . |
| 11 60 513 | 1/1964 | (DE) . |
| 43 02 905 | 3/1994 | (DE) . |
| 0 362 079 | 4/1990 | (EP) . |
| 0 431 764 | 6/1991 | (EP) . |
| 0 685 900 | 12/1995 | (EP) . |
| 97/22159 | 6/1997 | (WO) . |
| 98/01923 | 1/1998 | (WO) . |
| 98/36472 | 8/1998 | (WO) . |
| 98/37592 | 8/1998 | (WO) . |
| 98/48480 | 10/1998 | (WO) . |
| 99/17403 | 4/1999 | (WO) . |

OTHER PUBLICATIONS

Beckmann C et al.: "Antenna Systems for Polarization Diversity", Microwave Journal, Bd. 40, Nr. 5, 1. (May 1997).

Heilmann, A.: Antennen, Zweiter Teil, Wien/Zurich, 1970, S. 47–50.

Zehentner, H.: Neue Sendeantenne fur terrestrisches Fernsehen . . . , Berlin, Offenbach, 1994, S. 357–362.

"Dual–Frequency Patch Antennas"; S. Maci and G. Biffi Gentili, IEEE Antennas and Propagation Magazine, vol. 39, No. 6, Dec. 1997.

* cited by examiner

*Primary Examiner*—Tan Ho
(74) *Attorney, Agent, or Firm*—Nixon & Vanderhye

(57) ABSTRACT

A dual-polarized multiband antenna includes first and second radiating element modules having first and second dipole elements. First dipole elements are positioned at right angles to one another to transmit and/or receive radiation in the first frequency band range with two linear orthogonal polarizations. The dipole elements form a dipole square. The second radiating element module transmits or receives radiation in a second frequency band range higher than the first frequency band range. The second module has dipole elements orthogonally related to one another and aligned parallel or at right angles to the first dipoled elements. The second dipoles are arranged in a cruciform.

14 Claims, 6 Drawing Sheets

DUAL POLARIZED MULTI-RANGE ANTENNA

BACKGROUND OF THE INVENTION

The invention relates to a dual-polarized multiband antenna.

Dual-polarized multiband antennas are used for transmitting (or receiving) two linear polarizations which are aligned at right angles to one another and may be aligned, for example, vertically and horizontally. However, in practice those operational cases in which the polarizations are aligned at +45° and −45° to the vertical (or to the horizontal) are also of particular importance. In the case of dual-polarized multiband antennas, said antennas are operated in at least two frequency bands, as a rule with two mid-frequencies which are well apart from one another. In this case, the upper mid-frequency should be at least 1.5 times the lower mid-frequency.

With such a large frequency separation, two antenna modules or antenna arrays arranged physically separately from one another are normally used, namely for transmitting and receiving in the one frequency band range and for transmitting and receiving in the other frequency band range (frequency band).

Dual-polarized antennas as such are known. They are used for simultaneously transmitting or receiving two orthogonal polarizations. In this case, such radiating element arrangements may comprise, for example, a plurality of elements in the form of dipoles, slots, planar radiating elements or so-called patch radiating elements, as are known, for example, from EP 0 685 900 A1 or from the prior publication "Antennen [Antennas], Part 2, Bibliographical Institute, Mannheim/Vienna/Zurich, 1970, pages 47 to 50". Dipoles arranged in a cruciform shape (cruciform dipoles) or double-dipole arrangements which have a square structure in plan view (dipole square) are preferably used for the dipole arrangements.

Dual-polarized antennas are furthermore also known, for example, from WO 98/01923.

Dual-polarized antennas are likewise known from the publication "Dual-Frequency Patch Antennas", IEEE AP Magazine, page 13 et seq. This document describes dual-polarized multiband antennas which use different patch structures, but have a series of disadvantages. For example inadequate decoupling for both polarizations is thus typical. The described designs allow only one horizontal/vertical position alignment. For example, it is impossible with simple means to produce a multiple array arrangement with a +45°/−45° alignment.

Further antenna forms which have become known once again use two antennas arranged separately one above the other for the respective frequency range.

Finally, for example, a microstrip antenna is known from DE-A1 362 079, which is suitable for transmission in two frequency ranges, but with only one polarization. This antenna arrangement not only has a low gain, but it has also been found to be disadvantageous that the polar diagrams which can be achieved with such an antenna cannot be used for array antennas.

In contrast, the object of the present invention is to provide a dual-polarized multiband antenna, in particular a so-called X-polarized multiband antenna, which avoids the disadvantages mentioned above. This antenna is thus intended to be operable in at least two frequency ranges, which are preferably well apart from one another.

Furthermore, it is preferably intended to have a high level of decoupling between the two polarizations.

The object is achieved according to the invention in accordance with the features specified in Claim 1 and Claim 2. Advantageous refinements of the invention are specified in the dependent claims.

The dual-polarized multiband antenna according to the invention has previously unimagined advantages and features. These advantages relate not only to the decoupling, the bandwidth and the sensitivity, but also to the flexibility of the antenna. The antenna according to the invention is distinguished by the fact that it has at least one radiating element module in the form of a cruciform dipole and like a dipole square, which is located in front of a reflector and which can be operated with dual polarization in two alignments positioned at right angles to one another which, as a rule, that is to say preferably, assume an alignment of +45° and −45° to the vertical or horizontal. This radiating element module in the form of a dipole square can be operated in a lower frequency range. However, according to the invention, further dipoles are now provided for operation in a second upper frequency band with dual polarization, with the further dipoles being arranged within the dipole square. In addition, the further dipoles are preferably in the form of a cruciform dipole. The dipole elements are in this case aligned parallel or at right angles to the dipole elements of the dipole square and thus, in the case of an X-antenna, likewise have an alignment of +45° and −45° to the vertical or horizontal.

A development of the invention provides that the respective holder for the dipoles of the lower frequency range, which at the same time operate as so-called balancing, are designed and/or arranged and/or dimensioned such that, in consequence, no resonance occurs in the upper frequency range, or at least no relevant resonance occurs in the upper frequency range.

It has furthermore been found to be advantageous if, depending on the frequency-dependent wavelength associated with them, the height of the dipoles are [sic] arranged such that they are not more than one wavelength away from the reflector or the reflector plane. Advantageous values are in a range from ⅛ to ½ of the respective operating wavelength.

Above all, it is surprising in the case of the antenna according to the invention that, firstly, it has a broad bandwidth and, secondly, at the same time has a high level of decoupling between the two polarizations. It is also distinguished above all in that, with the antenna according to the invention, it is possible to ensure that the horizontal half beamwidths of the two radiating element modules are identical or virtually identical, that is to say essentially of the same magnitude, in both the lower and the upper frequency band ranges.

The advantages according to the invention can, above all, be achieved even when the antenna according to the invention is constructed not only with a dipole square and a cruciform dipole arranged in it, but like an antenna array with a plurality of such square dipoles, each having further internal dipoles, preferably in the form of cruciform dipoles. With this embodiment in particular, it is possible to provide a further radiating element module for transmission of the upper frequency band between each of the two dipole squares for transmitting and receiving the lower frequency band.

However, this further radiating element module is then preferably not in the form of a cruciform dipole, but likewise in the form of a dipole square.

BRIEF DESCRIPTION OF THE DRAWINGS

The invention will be explained in more detail in the following text with reference to the drawings in which, in detail.

DETAILED DESCRIPTION OF THE INVENTION

Figure 1:
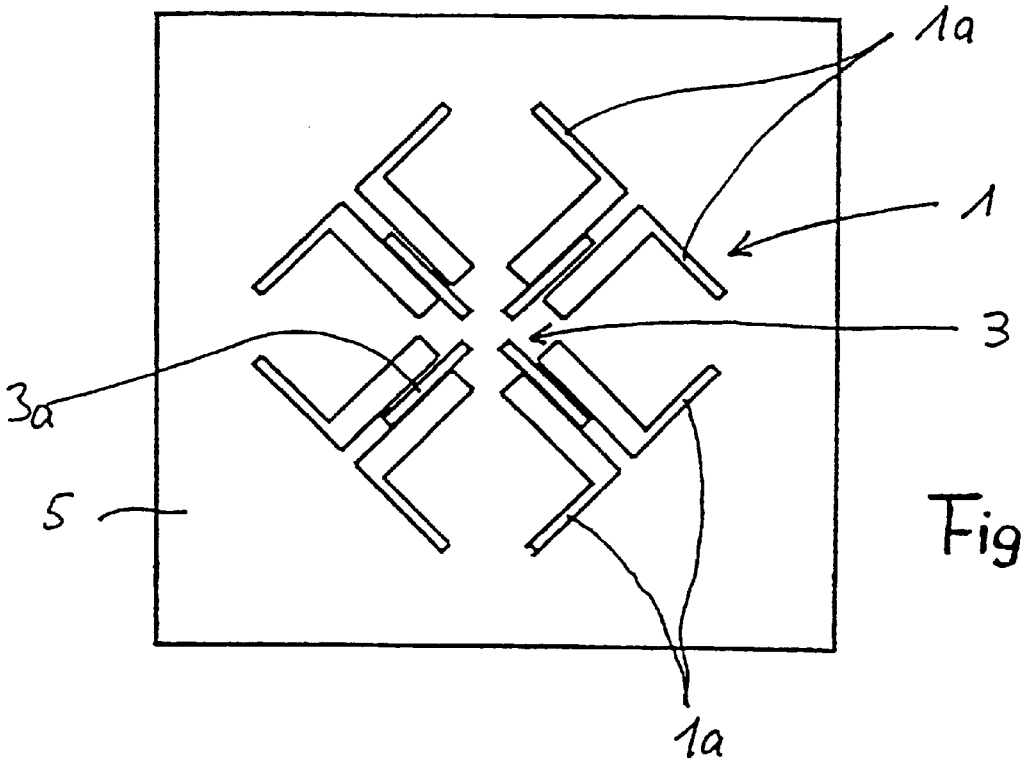
FIG. 1 shows a schematic plan view of an exemplary embodiment according to the invention of a dual-polarized multiband antenna.
Figure 2:
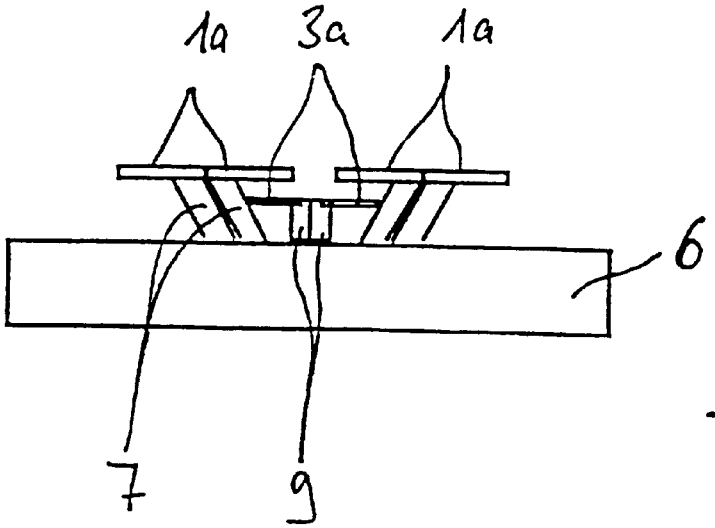
FIG. 2 shows a schematic side view parallel to the reflector.

FIGS. 1 and 2 respectively show a schematic plan view and side view parallel to a reflector of a dual-polarized multiband antenna, which comprises a first radiating element module 1 for a first frequency range and a second radiating element module 3 for a second frequency range.

The two radiating element modules 1, 3 are arranged in front of a reflector 5 whose shape is virtually square in the illustrated exemplary embodiment. The reflector is conductive. A supply network may be located on the rear face of the reflector, via which the first and the second radiating element modules are electrically connected, separately. The first radiating element module 1 in this case comprises a plurality of dipoles 1*a,* namely four dipoles 1*a* in the illustrated exemplary embodiment, which are arranged like a dipole square. The dipoles 1*a* are mechanically held via a so-called balancing device 7 with respect to the reflector or a plate located behind it and electrical contact is made with them, that is to say they are fed, via the said supply network.

In the horizontal transmission direction, the reflector plate itself has in each case one reflector edge 6, which in the illustrated exemplary embodiment projects to a certain height at right angles from the plane of reflector plate 5, thus allowing the polar diagram to be influenced in an advantageous manner.

The length of the dipole elements in the first radiating element module is matched such that corresponding electromagnetic waves can be transmitted or received via it in a lower frequency range. The orthogonal alignment of the dipole elements thus results in a dual-polarized antenna in a known manner. In the exemplary embodiment, the dipoles 1*a* are respectively aligned at angles of +45° and −45° with respect to the vertical (or, equally, with respect to the horizontal), to be precise forming an antenna which is also referred to for short as an X-polarized antenna.

The second radiating element module 3 is now located within the first radiating element module 1, which is in the form of a dipole square. This second radiating element module 3 is not in the form of a dipole square, but in the form of a cruciform dipole, in the illustrated exemplary embodiment. The two dipoles 3*a,* which are positioned at right angles to one another, are likewise once again mechanically supported with respect to the reflector or a plate located behind it, and are electrically fed, via the balancing network 9 associated with them.

This second radiating element module 3 is operated in an upper frequency range, with the upper mid-frequency in the illustrated exemplary embodiment being approximately twice the lower mid-frequency of the first radiating element module 1. This arrangement allows horizontal half-beamwidths of about 60° to be produced in the two frequency ranges, with high decoupling levels between the different ±45° polarizations being achieved at the same time. However, a comparable arrangement is likewise conceivable which, rather than an X-shaped alignment, has a vertical/horizontal alignment, in which the one set of dipole elements 1*a* and 3*a* are aligned horizontally, and the dipole elements which are at right angles are aligned vertically with respect to them.

As is evident from the illustration from the side shown in FIG. 2, it can be seen that both the first and the second radiating element modules 1, 3 are arranged at a distance in front of the reflector 5, to be precise at different distances. The height of the dipoles above the reflector should be not more than the operating wavelength for the associated operating frequency, and preferably not more than half the associated operating wavelength. However, the distance is preferably more than 1/16, in particular more than 1/8 of the associated operating wavelength.

Surprisingly, despite the mutually interleaved arrangement of the radiating element modules, with the first radiating element module comprising a dipole square and the second radiating element module 3 preferably comprising a cruciform dipole, the antenna formed in such a way has characteristic properties which are outstanding in this way. The fact that a similar polar diagram, which would not intrinsically be expected, is obtained for the two radiating element modules in the two frequency ranges may, possibly, be explained, inter alia, by the dipole elements 1*a* of the first radiating element module acting as reflectors for the second radiating element module 3.

Figure 4:
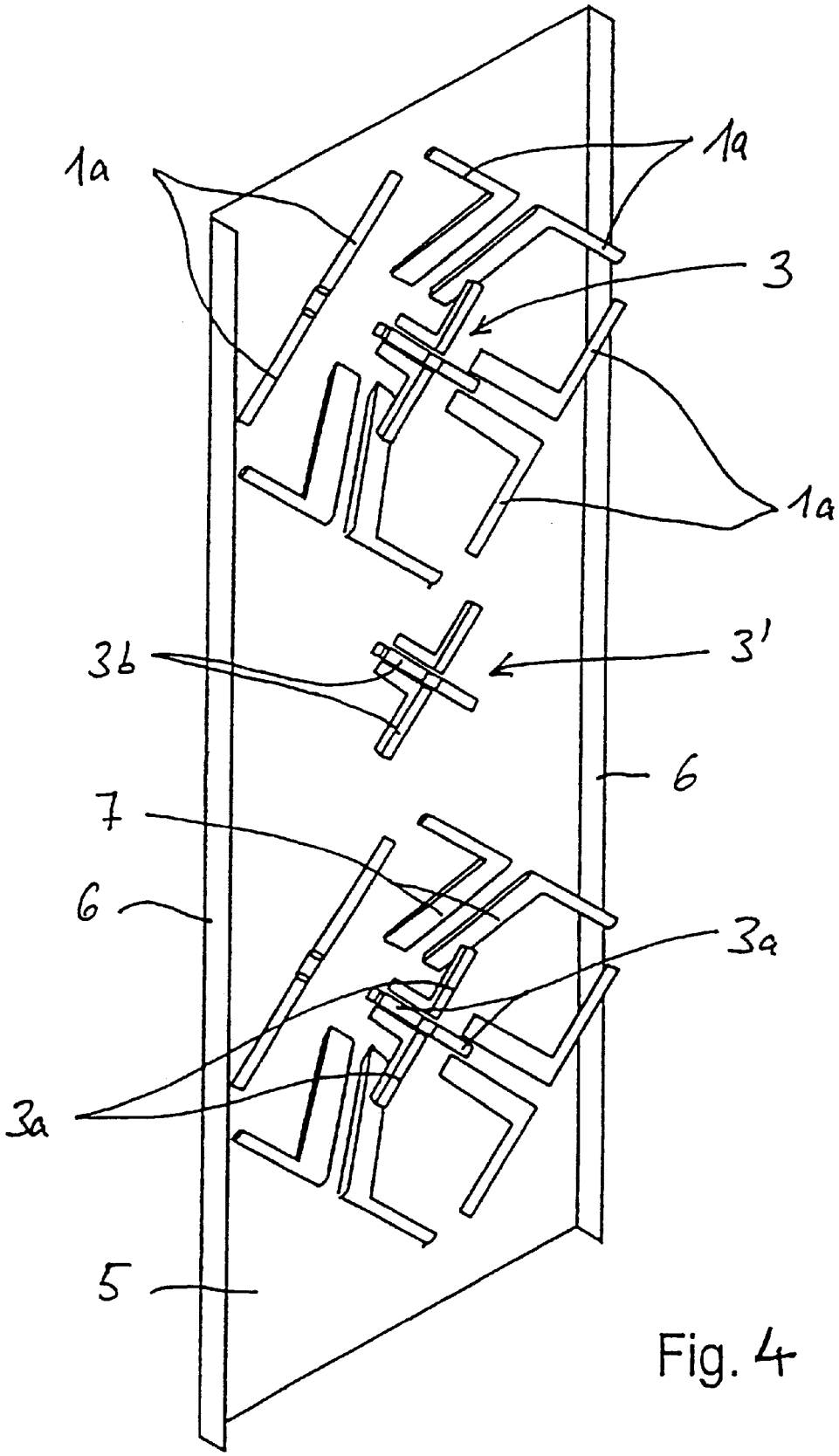
FIG. 4 shows a modified exemplary embodiment having a plurality of antenna module combined to form an array.

An upgraded dual-polarized multiband antenna is shown in FIG. 4, which illustrates an embodiment for higher antenna gain levels.

Figure 3:
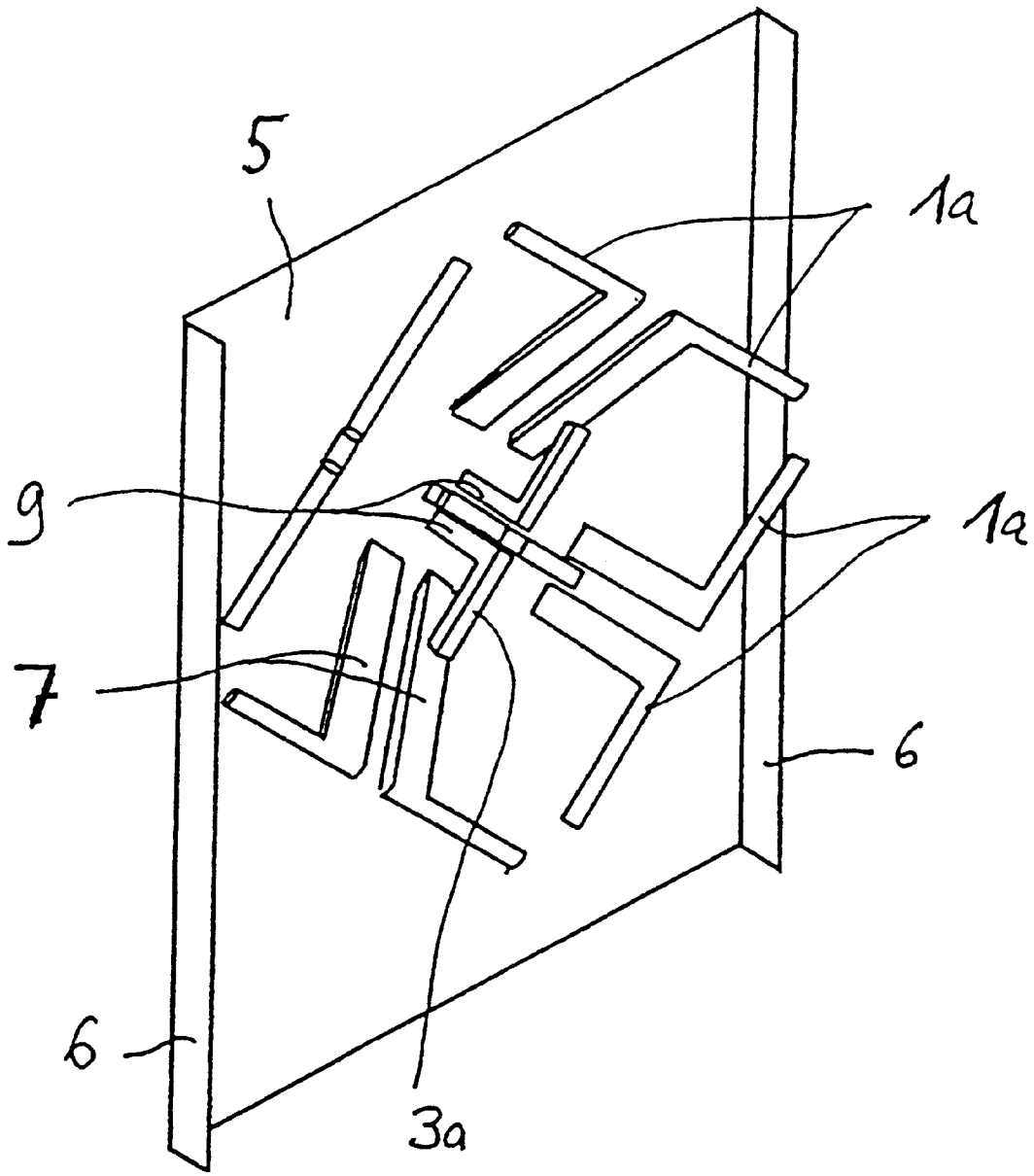
FIG. 3 shows a schematic perspective illustration of the exemplary embodiment shown in FIG. 1 and FIG. 2.

To achieve this, a plurality of dipole arrangements, as explained with reference to FIGS. 1 to 3, have to be cascaded appropriately. In the illustrated exemplary embodiment, the dual-polarized multiband antenna formed in this way comprises two antenna arrangements as explained with reference to FIGS. 1 to 3, in which the radiating element modules are once again aligned in the ±45° direction with respect to one another, and the fitting directions of the two antenna arrangements shown individually in FIG. 1 are arranged one above the other in the vertical direction. In the same way, the antenna modules may alternatively be assembled to form an antenna array in the horizontal fitting direction. Finally, a number of antenna modules may also be cascaded laterally alongside one another and one above the other in a number of rows and columns.

The intermediate spaces produced in this way between the respective first radiating element modules 1 for the lower frequency range are filled by corresponding radiating element arrangements for the upper frequency range, that is to say with additional second radiating element modules 3'. In other words, in the illustrated exemplary embodiment, two radiating element modules 1 and one second radiating element module 3 with dipole elements 3*b* are arranged in front of a reflector plate. The antenna produced in this way has a high vertical gain, with the same horizontal half-beamwidth of about 60° being achievable for both radiating element modules.

Figure 5:
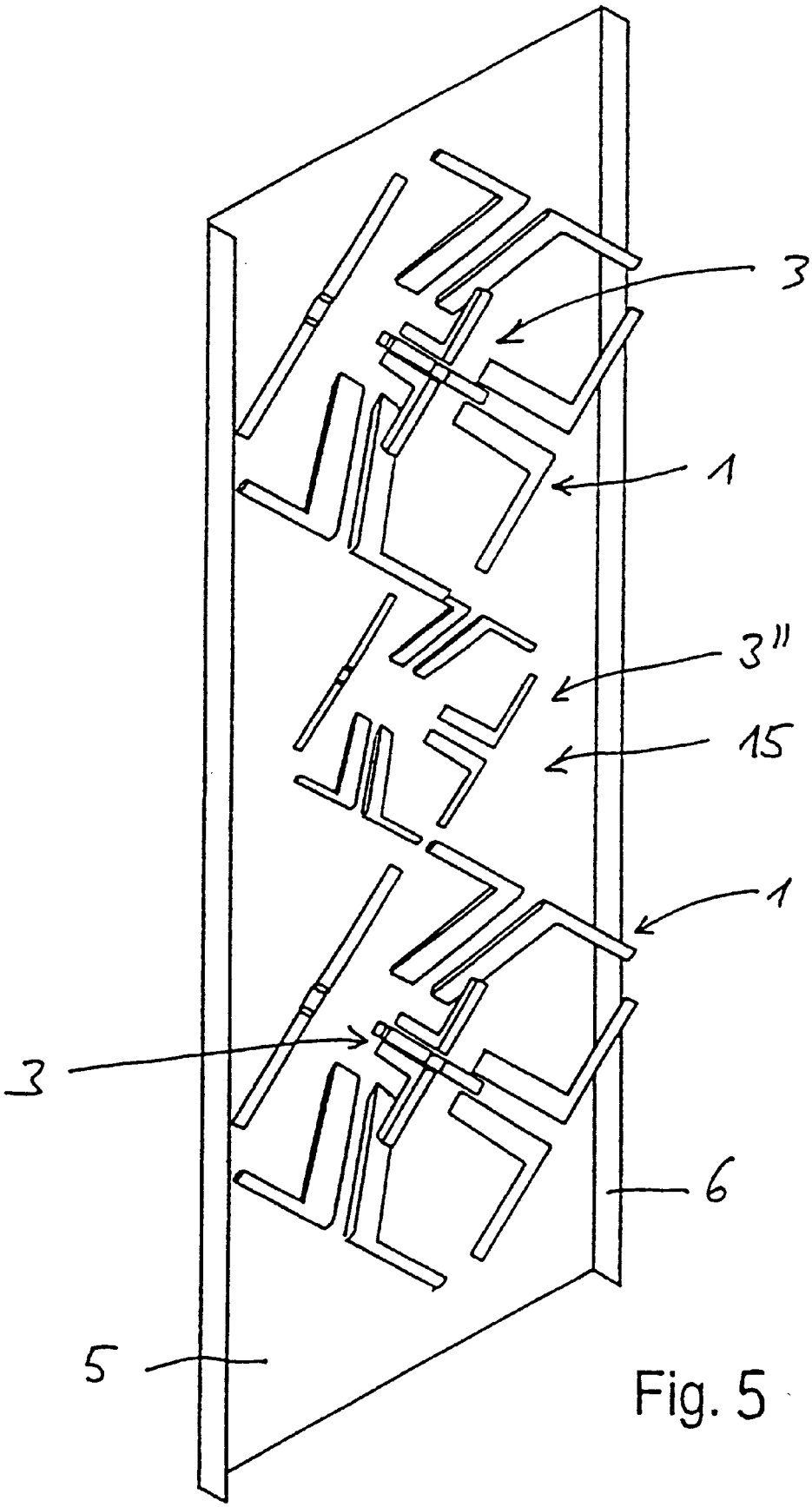
FIG. 5 shows an exemplary embodiment modified from that in FIG. 4.
Figure 6:
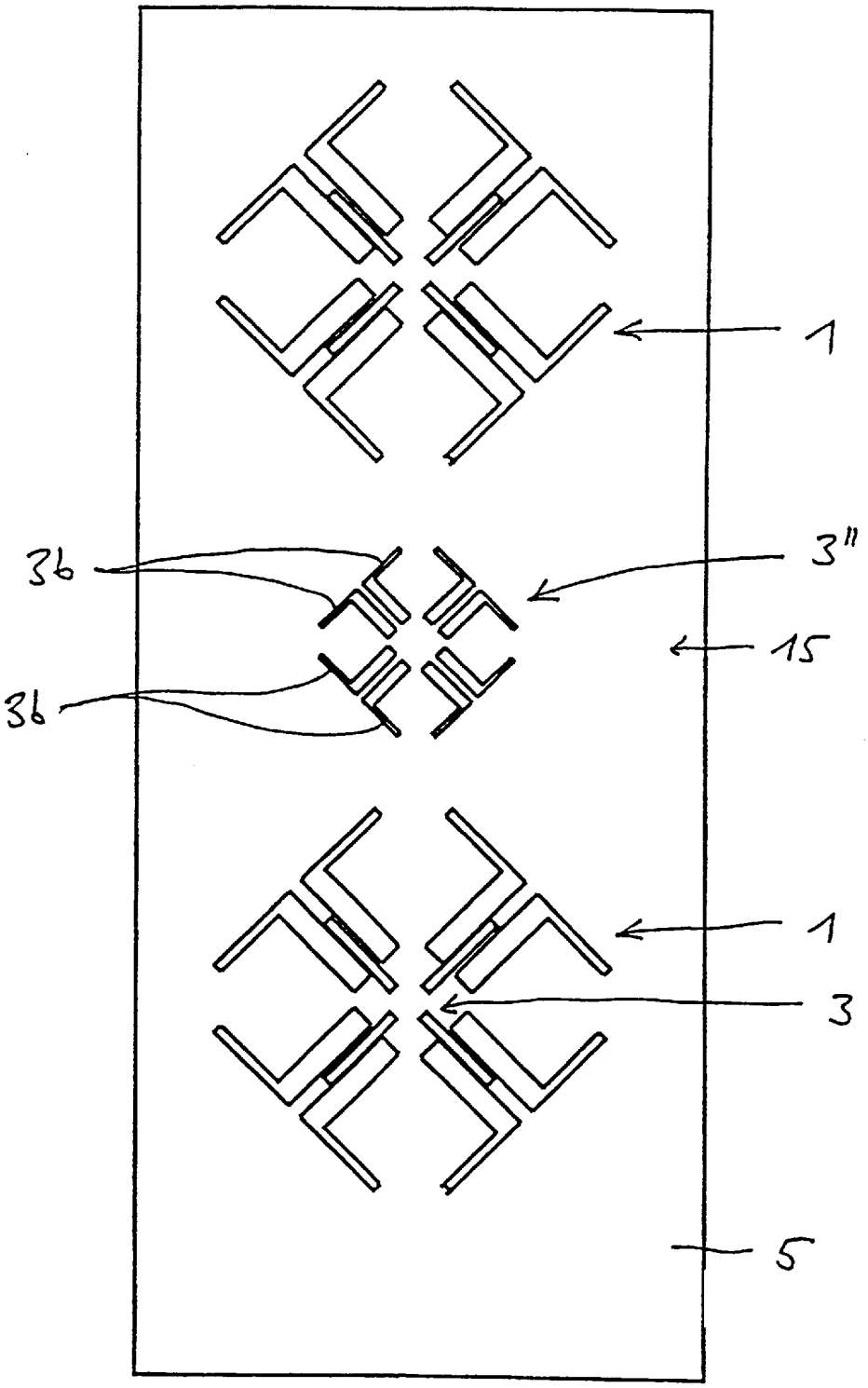
FIG. 6 shows a plan view of the exemplary embodiment shown in FIG. 5.
Figure 7:
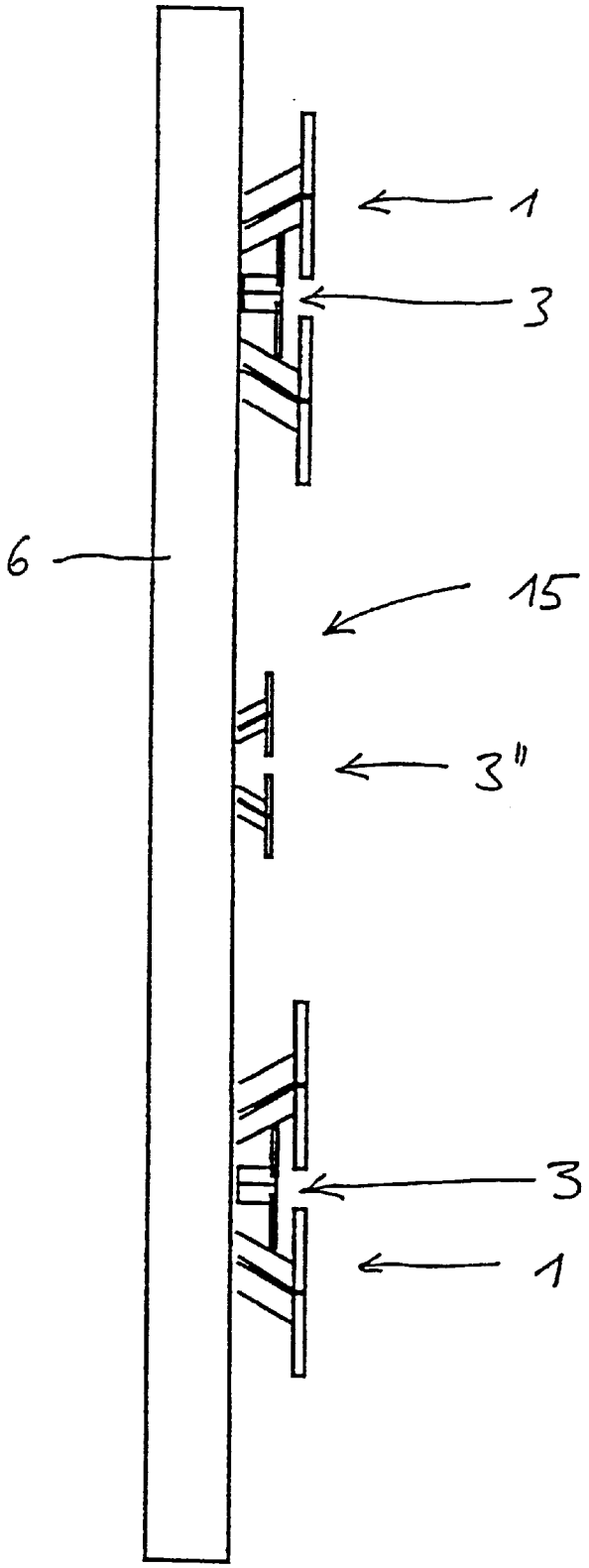
FIG. 7 shows a side view of the exemplary embodiment shown in FIGS. 5 and 6.

Finally, the exemplary embodiment in FIG. 5 shows that the radiating element modules 3 arranged in the first radiating element modules 1 may differ from the second radiating element modules 3' which are arranged in the spaces 15 between the first dipole squares 1. This is because, as can be seen from FIGS. 4 and 5, the additional radiating element module 3 arranged between two radiating element modules 1 in FIG. 4 comprises a cruciform dipole, that is to say a cruciform dipole arrangement, and in the embodiment shown in FIG. 5 it comprises a dipole square, that is to say, in general, a dipole arrangement 3" similar to a dipole square and having dipole elements 3*b*. This fine adaptation and matching allows the half-beamwidths of the radiating element arrangement for the upper and lower frequency ranges to be equalized better.

What is claimed is:

1. A dual polarized multiband antenna comprising:

a reflector;

a first radiating element module having first dipole elements positioned at right angles to one another for transmitting and receiving electromagnetic radiation in a first frequency band range with two linear orthogonal polarizations, said first dipole elements being arranged in a dipole square and located in front of the reflector with the dipoles being aligned in an alignment of ±45° with respect to a vertical, and a second radiating element module for transmitting and receiving electromagnetic radiation in a second frequency band range higher than the first frequency band range;

said second radiating element module being arranged within the dipole square of the first radiating element module;

said second radiating element module including dipole elements aligned orthogonally with respect to one another;

said second dipole elements being aligned parallel or at right angles to said first dipole elements;

the ratio of a mid-frequency of said second frequency band range to a mid-frequency of the first frequency band range being between 1.5 and 4.

2. An antenna according to claim 1, wherein the maximum distance of the first and second dipole elements from the reflector is less than an operating wavelength associated with the respective dipole elements.

3. An antenna according to claim 1, wherein the minimum distance of the dipole elements from the reflector is equal to or greater than $1/16^{th}$ of an associated operating wavelength.

4. An antenna according to claim 1 including holders for the dipole elements, said holders being provided for the first frequency band range and configured to operate off resonance in the second frequency band range.

5. An antenna according to claim 4, wherein said holder of the dipole elements of the first radiating element module is formed by balancing associated dipole elements.

6. An antenna according to claim 1, wherein the dipole elements are symmetrical with respect to a plane positioned at right angles to the reflector and passing through corners of the dipole square of the first radiating element module.

7. A dual polarized multiband antenna for transmitting and/or receiving electromagnetic radiation with two linear orthogonal polarizations and two frequency band ranges comprising:

a first antenna device including first dipoles positioned at right angles to one another to form a dipole square;

said first antenna device for transmitting and/or receiving electromagnetic radiation in a first frequency band range;

a second antenna device having second dipoles positioned at right angles to one another forming a cruciform dipole arranged within the first antenna device, said second antenna device for transmitting and/or receiving electromagnetic radiation in a second frequency band range;

a reflector, said first and second antenna devices being arranged in front of said reflector;

the second dipoles of the cruciform dipole being aligned parallel or at right angles to the first dipoles of the first antenna device;

the ratio of a mid-frequency of the second frequency band range to a mid-frequency of the first frequency band range lying between 1.5 and 5.

8. An antenna according to claim 7 including holders for the dipole elements of the first antenna device, said holders being provided for the first frequency band range and configured to operate off resonance in the second frequency band range.

9. An antenna according to claim 8 wherein said holder of the dipole elements for said first antenna device is formed by balancing associated dipole elements.

10. An antenna according to claim 7, wherein dipole elements are symmetrical with respect to a plane positioned at right angles to the reflector and passing through corners of the dipole square of the first antenna device.

11. An antenna according to claim 7 including a plurality of said first and second antenna devices, said second antenna devices being arranged in the interior of said first antenna devices respectively and spaced different distances from one another relative to the reflector.

12. An antenna according to claim 11, wherein said first antenna devices are spaced from one another, one of said second antenna devices being located intermediate an adjacent pair of said first antenna devices.

13. An antenna according to claim 12, wherein said one of said second antenna devices is located intermediate said adjacent pair of said first antenna devices comprises a cruciform dipole.

14. An antenna according to claim 12, wherein said second antenna device disposed intermediate said adjacent pair of first antenna devices is in the form of a dipole square.

* * * * *